United States Patent [19]

Van Meter

[11] Patent Number: 4,483,558

[45] Date of Patent: Nov. 20, 1984

[54] DOOR SECURITY DEVICE

[76] Inventor: Verial V. Van Meter, Rt. #1 - Box 570-B, Burns, Tenn. 37029

[21] Appl. No.: 323,902

[22] Filed: Nov. 23, 1981

[51] Int. Cl.[3] ..... E05C 17/12

[52] U.S. Cl. ..... 292/339

[58] Field of Search ..... 292/338, 339, 262

[56] References Cited

U.S. PATENT DOCUMENTS

| | | | |
|---|---|---|---|
| 2,277,939 | 3/1942 | Thalhammer | 292/338 X |
| 4,136,899 | 1/1979 | Frasher | 292/338 |
| 4,176,870 | 12/1979 | Cracraft | 292/338 |

*Primary Examiner*—Richard E. Moore

*Attorney, Agent, or Firm*—Harrington A. Lackey

[57] ABSTRACT

A door security device for bracing a door against illegal entry, having an elongated rod member of telescoping rod sections, a reversible foot member pivotally connected to the lower end of the rod member, the upper end portion of the rod member comprising an abutment member for engaging the surface of the door beneath a doorknob, an annular head pivotally connected to the upper end of the rod member for engaging the shaft of the doorknob, and an inelastic linear member threaded transversely of the head and over the doorknob shaft in operative position for securing the head upon the doorknob.

11 Claims, 12 Drawing Figures

DOOR SECURITY DEVICE

BACKGROUND OF THE INVENTION

This invention relates to a door security device, and more particularly to a brace-like member for securing the door against illegal entry.

Door guards or door security devices of the brace-type are well known in the art, as shown in the following U.S. Pat. Nos. 598,405, Williams, Feb. 1, 1898; 1,304,394, Shyer, May 20, 1919; 1,944,783, Ciriacy et al, Jan. 23, 1934; 1,985,164, Green, Dec. 18, 1934; 2,073,024, Potter, Mar. 9, 1937; 3,583,743, Newell, June 8, 1971; 4,019,765, Nichola, Apr. 26, 1977; 4,036,518, Jost, July 19, 1977; 4,139,227, Spurr, Feb. 13, 1979; 4,157,128, Peters, June 5, 1979; 4,176,879, Cracraft, Dec. 4, 1979.

All of the above patents, except Ciriacy et al, Green and Potter, disclose brace-type door security devices having an elongated rod member made of telescoping rod sections, a foot at the lower end of the rod member for engaging the floor, and an upper head or yoke for engaging the doorknob shaft, to secure the rod member at an angle to the floor for bracing the door against illegal entry.

Ciriacy et al, Green and Potter disclose door stops having inclined legs with a foot portion for engaging the floor and a head portion permanently secured to the door, independently of the doorknob.

Ciriacy et al, Green, Potter, Williams, Newell and Peters disclose foot members having different types of shoes for engaging different types of floor surfaces.

Shyer, Nichola, and Cracraft disclose doorknob heads having circular devices for encircling the doorknob shaft. The heads of Shyer and Cracraft completely surround the doorknob shaft, but include separably connected pieces. The Nichola doorknob head is unitary, but hook-shaped to provide an opening for insertion laterally over the doorknob shaft.

None of the above patents disclose a completely circular, uitary, plate-like head having an opening large enough to fit over the doorknob, nor do any of the above patents disclose an abutment member on the upper end of the rod member for projecting beyond the doorknob head for engaging the door, in operative position, in order to absorb the maximum portion of the thrust of any force upon the door against the security device.

SUMMARY OF THE INVENTION

It is therefore an object of this invention to provide a door security device, or door guard, of the brace-type, which includes an elongated rod member having telescoping rod sections, a foot member pivotally mounted to the lower end of the rod member for engaging the floor, and an annular plate-like head or collar pivotally secured to the upper end portion of the rod member to fit over the doorknob of the door to be secured.

The annular plate-like head has a groove or recess at the bottom thereof for receiving the doorknob shaft to prevent lateral movement of the security device, when it is in its operative position. The lower portion of the head forms a depending shank terminating in a yoke having opposed legs and an upper bight portion for straddling and being pivotally secured to the upper end portion of the rod member. The upper end portion of the rod member forms an abutment member, preferably padded on its upper end, extending through the yoke and abutting the surface of the door beneath the doorknob shaft, when the security device is angularly supported in its operative position for securing the door. Thus, the abutment member will absorb the maximum portion of the thrust of any force exerted against the door in order to relieve the stress on the head as well as the doorknob shaft and doorknob. Furthermore, the thrust absorbed by the abutment member transmits the thrust directly, and axially, through the rod member and the foot member to the floor.

The abutment member projects far enough through the yoke so that the bight portion of the yoke functions as a stop to limit pivotal movement of the head relative to the rod member.

An inelastic linear member, such as a cord or string, is threaded across the opening in the annular head so that it may be drawn taut against the upper portion of the doorknob shaft to hold the doorknob shaft within the lower groove of the head. A latch member or cord-lock may be secured to a portion of the cord projecting from the head to hold the cord in its taut position. The free end of the cord may be secured to a pivot pin removably extending through the legs of the yoke and the upper end portion of the rod.

The foot member is pivotally connected to the lower end portion of the rod member and is provided with opposed shoes of different structures, for engaging different types of floor surfaces. For example, one shoe may be provided with projecting teeth for engaging carpet-like surfaces, while the opposite shoe may constitute a high-friction surface, such as rubber, or rubber-like plastic, for frictionally engaging a smoother floor surface. Thus, by rotating the foot member about its pivotal axis, the desired shoe will be brought into engagement with a corresponding floor surface.

In one form of the invention, the rod member may include a pair of telescoping rod sections, one rod section having a pin hole, and the other rod section having a plurality of axially spaced, height-adjustment pin holes, so that the rod sections may be latched in various axially adjusted positions by a locking pin, to accommodate doorknobs of different heights. In this security device, a linear gauge is impressed upon the rod member to measure the approximate height of the doorknob above the floor. The height indicia then determines the corresponding pin hole location for latching the rod sections in an operative position in which a substantially uniform bracing angle may be maintained between the rod member and the floor.

In another form of the invention, the rod member may include three telescoping rod sections, with a fourth rod section of a different length for interchanging with one of the other three rod sections in order to provide a security device of two different lengths.

DESCRIPTION OF THE PREFERRED EMBODIMENTS

Figures 1, 4, 5, 6, 7:
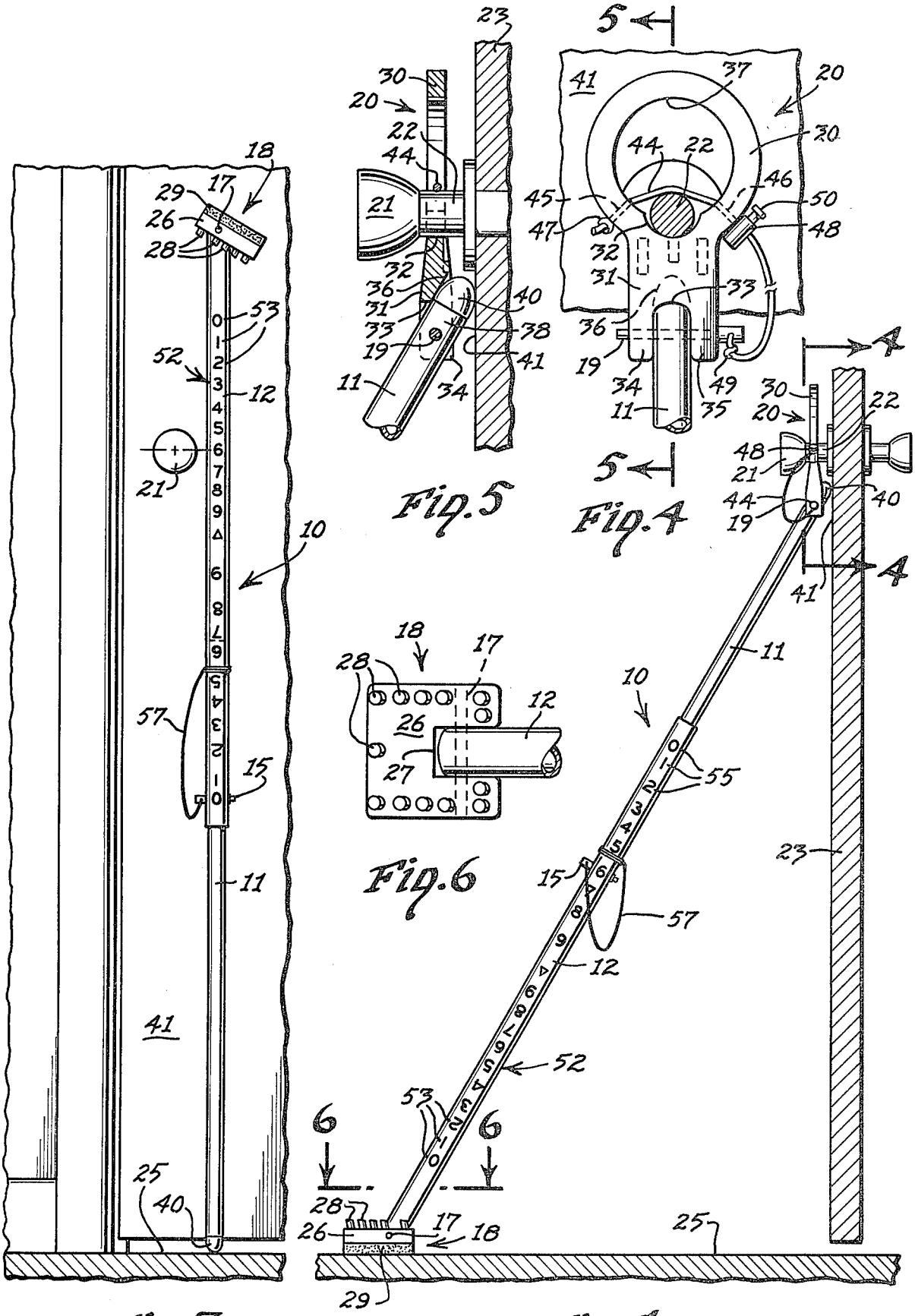
FIG. 1 is a side elevation of one form of the door security device, in operative position, supported between the door of a room to be secured, and the floor, shown in section.
FIG. 4 is an enlarged fragmentary section taken along the line 4—4 of FIG. 1.
FIG. 5 is a fragmentary section taken along the line 5—5 of FIG. 4.
FIG. 6 is an enlarged section taken along the line 6—6 of FIG. 1, with the floor omitted.
FIG. 7 is a side elevational view of the door security device of FIG. 1, in a vertical, upside down position, illustrating the gauge for measuring the height of the doorknob.
Figures 2, 3, 8, 9, 10, 11, 12:
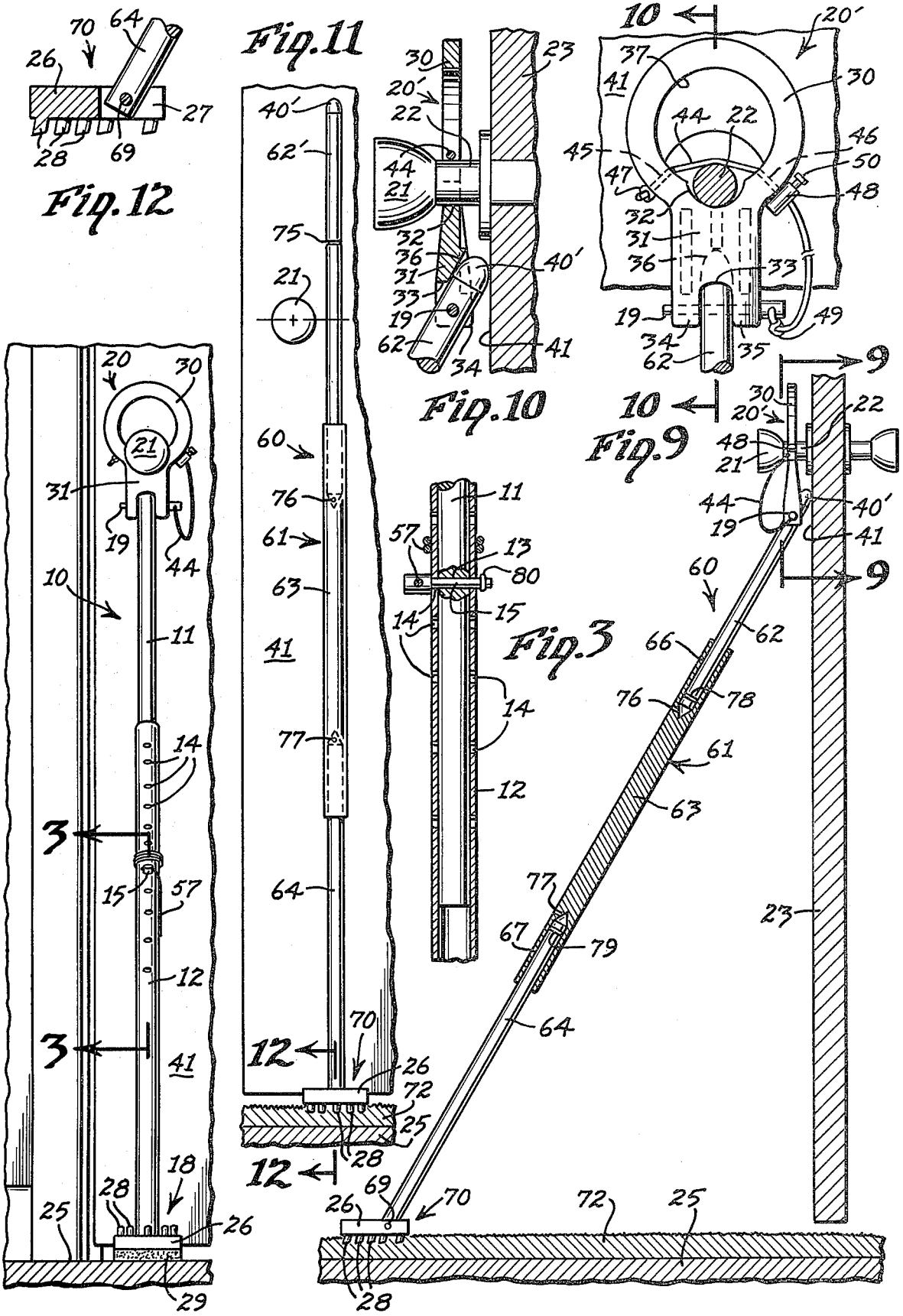
FIG. 2 is a front elevation of the door security device in the operative position disclosed in FIG. 1.
FIG. 3 is an enlarged fragmentary section taken along the line 3—3 of FIG. 2.
FIG. 8 is a side elevational view of a modified door security device, in operative position, with the door, floor, and middle rod section, disclosed in section.
FIG. 9 is an enlarged fragmentary section taken along the line 9—9 of FIG. 8.
FIG. 10 is a fragmentary section taken along the line 10—10 of FIG. 9.
FIG. 11 is a front elevational view of the door security device disclosed in FIG. 8, in an upright vertical position for determining the relative height of the doorknob.
FIG. 12 is an enlarged fragmentary section taken along the line 12—12 of FIG. 11 of the foot member, in operative position, with the carpet and floor removed.

Referring now to the drawings in more detail, FIGS. 1 and 2 disclose one form of door security device 10 made in accordance with this invention, including an elongated rod member comprising an upper rod section 11 telescopingly received in a lower or base rod section 12. Extending diametrically and transversely through the upper rod section 11 is a pin hole 13 (FIG. 3) adapted to register with any pair of diametrically opposed, height adjustment apertures or pin holes 14 axially spaced in the wall of the lower rod section 12. The pin holes 13 and 14 are adapted to slidably receive transversely a locking pin 15 in order to lock the upper rod section 11 in any one of several axially adjusted positions relative to the lower rod section 12. In this manner, the overall length of the rod member 11-12 may be adjusted to accommodate doorknobs of different heights.

Pivotally mounted upon the lower extremity of the lower rod section 12 by a pivot pin 17 is a foot member 18, and pivotally supported upon the upper extremity of the upper rod section 11 by a removable pivot pin 19 is a doorknob head or collar 20.

When the security device 10 is in its operative position, as disclosed in FIG. 1, the head 20 fits over the doorknob 21 and around the doorknob shaft 22 of a door 23 of a room to be secured, when the door 23 is closed. The foot member 18 frictionally engages the floor 25 of the room to be secured so that the rod member 11-12 will be disposed in a diagonal, or angular, bracing position to prevent forcible entry through the doorway secured by the door 23.

The foot member 18 preferably includes a shoe 26 of solid material, such as metal, having a notch 27 in one end thereof for receiving the lower extremity of the lower rod section 12 for pivotal movement about the pivot pin 17. One face, the upper face in FIG. 1, of the shoe 26 is provided with a plurality of spaced projecting teeth 28, which may be sharpened or bevelled, as shown in the drawings to securely penetrate and engage the pile surface of a pile carpet, such as the carpet 72 illustrated in FIG. 8, when the shoe 26 is rotated 180° about the axis of the pivot pin 17 from its position disclosed in FIG. 1.

The opposite face of the shoe 26, the lower face disclosed in FIG. 1, is covered by an anti-friction, or non-skid pad 29 of a material having a relatively high coefficient of friction, such as rubber or certain types of rubber-like plastics. The non-skid pad 29 is utilized when the foot member 18 is in the position disclosed in FIG. 1 for engaging smooth floor surfaces, such as linoleum or tile. Thus, the foot member 18 is sufficiently versatile that by merely rotating the shoe 26 about its pivot pin 17 through 180°, the foot member 18 is adapted to securely grip or bind itself to the corresponding floor surface, whether a smooth surface or a pile carpeted surface. Moreover, the gripping and holding function of the foot member 18 is increased by increased pressure exerted upon the foot member 18 through the force transmitted axially along the rod section 12 from the door 23.

The doorknob head 20 is preferably made of solid unitary material, such as steel, polycarbonate, or other suitable material. The head 20 includes an annular or circular doorknob-engaging ring 30 having a large circular opening 37 to fit over the doorknob 21, and a lower depending shank portion 31. The ring 30 is preferably continuous to lead strength to the head 20.

A substantially semi-circular groove 32 is formed in the bottom or lowermost portion of the ring 30 for cradling or receiving the doorknob shaft 22 when the ring 30 is placed over the doorknob 21, as best disclosed in FIG. 4.

The shank portion 31 has its lower end portion bifurcated to include a bight portion 33 and a pair of depending legs 34 and 35 between which are received the upper end portion 38 of the upper rod section 11. This upper end portion 38 is pivotally connected to the shank portion 31 by the pivot pin 19 extending through registering holes in both legs 34 and 35 and the upper end portion 38, as best disclosed in FIGS. 4 and 5. Moreover, the bight portion 33 defines a rearward and upward projecting angular channel 36 for receiving and bearing against the upper end portion 38 of the rod section 11, as best disclosed in FIG. 5. The upper end portion 38 includes an abutment member 40, preferably of relatively soft resilient material, such as rubber, for abutting against the front surface 41 of the door 23, as illustrated in FIG. 5. Thus, when an external force is exerted against the door 23, the abutment member 40 will absorb the major portion of the thrust, and transmit one component of the force axially along the rod sections 11 and 12, and through the foot member 18 to the floor 25. Another component of the force will be transmitted by the upper portion of the rod section 38 against the channel 36, and through the shank portion 31 and groove 32 to the doorknob shaft 22. In this manner, the doorknob 21 and its shaft 22 will only absorb a portion of the thrust from an external force exerted against the door 23.

The groove or recess 32 prevents relative lateral shifting between the doorknob shaft 22 and the head 20, when the device 10 is in its operative position, and when force is exerted against the outside of the door 23.

In order to further assist in retaining the ring 30 about the doorknob shaft 22, an inelastic linear member, such as a flexible cord 44, is knotted at one end 47 and threaded through opposed apertures 45 and 46 in the ring 30 on the opposite sides of the groove 32. The cord 44 is sufficiently long that it may be pulled upward far enough to permit the doorknob 21 to pass beneath the cord 44 as the head 20 is fitted over the doorknob 21, or removed from the doorknob 21, without removing the cord 44 from the aperture 46.

After the cord 44 is drawn taut across the doorknob shaft 22, the cord 44 may be secured in its drawn position, by a conventional, manually releasable, spring-actuated latch member or cordlock 48 mounted on the cord 44, as illustrated in FIG. 4. By depressing the plunger 50, the cordlock 48 may be slidably moved along the cord 44 until it engages the outer surface of the ring 30. By releasing the plunger 50, the cordlock 48 grips the cord 44 and prevents the cord 44 from slipping through the aperture 46.

The opposite end of the cord 44 may be secured by the knot 49 to the head of the pivot pin 19, if desired, so that the cord 44 serves the double function of holding the head 20 in place about the shaft 22 and securing the pivot pin 19 to the head 20 to prevent loss of the pivot pin 19.

Since doorknobs 21 may be located at different heights on different doors 23, and it has been found in experimenting with this door security device 10, that the optimum angle at which the rod member 11-12 makes with the floor 25 is preferably in the range of 58°–62°, the base rod section 12 is provided with the axially spaced pairs of height adjustment pin holes 14 to permit adjustment of the overall length of the rod member 11-12.

In order to assist the owner or operator of the security device 10 in readily locating the particular pair of adjustment holes 14 which should register with the pin hole 13 for receiving the locking pin 15, a doorknob gauge 52 including axially spaced indicia, such as the numerals 53 ranging from 0–9 and the symbol Δ spaced at uniform increments, such as 1 inch, are marked upside down on the lower rod section 12, as clearly disclosed in FIGS. 1 and 7. Corresponding or matching indicia 55, in the form of numerals 0–9, as well as the same symbol Δ, are each marked adjacent a corresponding pair of pin holes 14 on the lower rod section 12. However, the numerals 55 are placed upon the lower rod section so that they may be read in a rightside up position, as illustrated in FIG. 1. If the numerals 53 are uniformly spaced, for example at one inch intervals, then the pairs of pin holes 14 will have non-uniform spacing. As a matter of fact, the axial spacing of the pin holes 14 may have a trigonometric relationship to the gauge 52, so that the total length of the rod member will increase in proportion to the increase in height of the doorknob, in order to maintain a substantially uniform angle between the rod member 11-12 and the floor 25.

Of course, because the height of doorknobs on various types of doors 23 do not vary in one inch increments the gauge 52 will not usually have one of its numerals 53 register exactly with the height of the doorknob 21 above the floor 25, and therefore there will, almost as a matter of course, be variances in the angle between the rod member 11-12 and the floor 25.

The rod member 11-12 is preferably disposed at an angle of 56°–62° with the floor 25, since this has been found by experiment to be the optimum angular range for providing the greatest resistance to external forces against the door 23 and still maintaining frictional engagement between the bottom surface of the foot member 18 and the floor 25.

In order to utilize the gauge 52, the upper rod section 11 is protracted to its maximum extent until the pin hole 13 registers with the pin holes 14 corresponding with the number 0 of the indicia 55, and the locking pin 15 inserted, as illustrated in FIG. 7. The security device 10 is turned upside down, as illustrated in FIG. 7, and the abutment member 40 rests on the floor 25 with the rod member 11-12 in vertical position adjacent the doorknob 21. The gauge 52 is then read to determine the numeral 53 or Δ symbol closest to the level of the doorknob 21.

As illustrated in FIG. 7, a numeral 6 on the gauge 52 corresponds to the height of the doorknob 21 above the floor 25. The security device 10 is then moved from its vertical position. The pin 15 is removed and the rod sections 11 and 12 contracted until the pin holes 14 identified by the numeral 6 register with pin hole 13. The locking pin 15 is reinserted into the newly aligned pin holes 13 and 14 to lock the upper rod section 11 in the lower rod section 12. The overall length of the rod member 11-12 now permits the rod member 11-12 to lie at the optimum angle with the floor 25 when the doorknob head 20 is fitted over the doorknob 21 and the foot member 18 engages the floor 25, as illustrated in FIG. 1. If the symbol Δ is closest to the doorknob level, the locking pin 15 is removed from the "0" pin holes 14 and reinserted in the pin holes 14 identified by the Δ symbol.

Although in FIG. 7, the security device 10 is illustrated with the head 20 removed, nevertheless the head 20 may remain assembled upon the upper end portion of the rod section 11, and the device 10 can still function to measure the height of the doorknob 21.

The locking pin 15 may be secured to the lower rod section 12 by a cord or lanyard 57, one end of which is secured to the locking pin 15 and the other end of which is wrapped around the rod section 12 and secured by tying, as illustrated in FIGS. 1 and 7.

FIGS. 8–12 disclose a modified door security device 60 including an elongated rod member 61 having three telescoping rod sections 62, 63 and 64. The middle rod section 63 is illustrated in FIG. 8 as an elongated solid bar having opposed coaxial sockets 66 and 67 for telescopingly receiving the respective upper rod section 62 and the lower rod section 64.

The lower extremity of the lower rod section 64 is pivotally connected by a pivot pin 69 to a foot member 70. The foot member 70 is identical to the foot member 18, except that it does not incorporate the anti-skid pad 29. The foot member 18 could be mounted on the rod section 64, instead of the foot member 70, if desired. The foot member 70 includes the same shoe 26 having a notch 27 for receiving the lower extremity of the lower rod section 64 for pivotal movement about the pivot pin 69. Moreover, the shoe 26 includes the same teeth 28 as illustrated in the foot member 18. The door security device 60 is particularly designed for securing rooms in which the floor 25 is covered by carpeting, such as the pile carpet 72 illustrated in FIG. 8. Thus, the security device 60 is particularly adapted for travelers who stay in hotel and motel rooms, whose floors are practically always covered by carpeting such as 72.

The upper extremity of the upper rod section 62 is provided with a soft resilient abutment member 40' identical to the abutment member 40, and is pivotally connected by pivot pin 19 to a doorknob head 20' which is identical in construction to the doorknob head 20, except possibly in size. Accordingly, the reference numerals identifying the parts of the head 20' will be identical to the reference numerals identifying corresponding parts of the doorknob head 20.

Because of the construction of the rod member 61, no provision is made for varying the length of the rod member 61 in order to accommodate doorknobs 21 of different heights, except that interchangeable upper rod sections of different lengths may be provided for substitution with the upper rod section 62. For example, in FIG. 11, an upper rod section 62' of greater length than the rod section 62, disclosed in FIG. 8, is illustrated.

Preferably a security device 60 will be sold with two interchangeable upper rod sections 62 and 62', so that at least two overall lengths of the rod member 61 will be provided for extreme differences in doorknob heights.

As illustrated in FIG. 11, the long upper rod section 62' is provided with an annular gauge groove 74 for utilization in determining which of the rod sections 62' or 62 be utilized in the device 60. The location of the gauge groove 75 above the doorknob 21, as illustrated in FIG. 11, indicates that the long rod section 62' is too long, and the short rod section 62 should be substituted, so that the rod member 61 will be at approximately the desired angle when the device 60 is mounted on the doorknob 21 for securing the door 23. On the other hand, if the annular groove 75 is level with or below the doorknob 21 when the rod member 61 is placed vertically beside the doorknob 21 with the foot member 70 resting upon the carpet 72, then the long rod section 62' will be retained for utilization with the doorknob 21 of the greater height.

In the utilization of either of the security devices 10 and 60, after the rod sections have been properly measured and fitted and secured in place, then the respective head 20 or 21', with the cord 44 loosened, is placed over the respective doorknob 21 with the cord 44 above the doorknob 21. The respective head 20 or 20' is raised until the groove or recess 32 firmly seats against the lower surface of the doorknob shaft 22. Then the cord 44 is drawn taut and the cordlatch 48 released by depression of the plunger 50, and moved toward and against the ring 30. The plunger 50 is then released to cause the latch member 48 to hold the cord 44 stretched taut across the top of the door shaft 22.

The respective foot member 18 or 70 is firmly seated against the corresponding floor surface 25 or 72 and the respective device 10 or 60 is then firmly secured in its operative position with the respective rod member 11-12 or 61 disposed at the optimum desired angles for resisting even exceptional external forces created by attempts to force the door 23 inward.

When it is desired to remove the devices 10 and 60 from their guard positions, the pivot pin 19 may be removed from the head 20 and the upper rod section 11 to separate the head and the rod section, thereby releasing the head member 20 from the doorknob shaft 22 and relieving the pressure against the foot member 18 or 70.

For transportation or storage, both security devices 10 and 60 may be partially disassembled to occupy less space and to be confined in a compact package, if desired. The head 20, as previously described, may be removed from the upper rod section 11, 62 or 62', by removing the pivot pin 19. The upper rod section 11, 62 or 62' may be removed axially from its respective lower rod section 12 or middle rod section 63. In the door security device 60, the lower rod section 64 may also be axially removed from the bottom of the middle rod section 63, to provide three separate rod sections, which can be confined in a smaller space, such as in a suitcase or other type of travel bag.

As illustrated in FIG. 8, the solid middle rod section 63 is provided with exhaust ports 76 and 77 to facilitate telescopic insertion of the respective rod sections 62 and 64 into their corresponding sockets 66 and 67, thereby preventing the entrapment of air between the respective sockets and rod sections.

Moreover, each of the rod sections 62 and 64 may be provided with annular grommets of frictional material, such as rubber, to assist in holding the rod sections 62 and 64 in their respective sockets 66 and 67.

Also, the latch pin 15, as best illustrated in FIG. 3 may be provided with an annular frictional grommet 80 to assist in holding the pin 15 in its latched position.

What is claimed is:

1. A security device for a door including a doorknob having a shaft portion, in which the door is adapted to close the entrance to a room havng a floor, comprising:

(a) an elongated rigid rod member having an upper end portion and a lower end portion, (b) a foot member adapted to engage the floor of a room having a door to be secured, (c) means supporting said foot member on said lower end portion, (d) said upper end portion terminating in an abutment member, (e) a head having a recess for receiving the shaft portion of a doorknob of the door to be secured, and (f) means pivotally connecting said head to said upper end portion for pivotal movement about an axis spaced from said abutment member, so that when said rod member is in an operative position for securing the door, said foot member engages the floor, said recess receives the doorknob shaft portion, and said abutment member projects toward and engages a portion of the door beneath the shaft portion to absorb a substantial portion of the thrust of the door when forced toward said rod member.

2. The invention according to claim 1, in which said head comprises a shank portion, said pivotal connecting means comprising means for pivotally connecting said shank portion to said upper end portion, said recess being spaced above said pivotal axis in said operative position.

3. The invention according to claim 2 in which said shank portion comprises upper and lower end portions, said lower end portions comprising a yoke having a pair of legs and a bight portion, said legs straddling said upper end portion of said rod member, and said pivotal connecting means comprising a pivot pin journaled through the upper end portion of said rod member and the legs of said yoke, said bight portion being spaced a lesser distance from said pivotal axis than said abutment member to provide a stop to limit the pivotal movement of said head relative to said rod member.

4. The invention according to claim 1 comprising a flexible inelastic linear member threaded through said head across the open upper end of said recess whereby said linear member may be loosened to form an enlarged loop for fitting over the doorknob having its shaft portion received in said recess and for being retracted to a taut position across the upper portion of said shaft portion received in said recess.

5. The invention according to claim 4 in which said head comprises wall portions projecting upward from the opposite sides of said recess, an aperture through each wall portion on opposite sides of said recess for receiving said linear member, and means for detachably holding said linear member in said taut position.

6. The invention according to claim 5 in which said means for holding said linear member in said taut position comprises a releasable latch member slidably movable along said linear member on the opposite side of one of said wall portions from said recess, sand the opposite end of said linear member being provided with stop means to limit the passage of said linear member through the aperture in the opposite wall portion.

7. The invention according to claim 6 in which said head comprises an annular ring including said opposite wall portions, said ring being large enough to fit over a doorknob of a door to be secured, and said recess being formed in the lower portion of said ring opening upward.

8. The invention according to claim 1 in which said abutment member comprises a relatively soft padded member for engaging the door surface.

9. The invention according to claim 1 i which said rod member comprises at least first and second telescoping rod sections, said first rod section comprising a plurality of vertically spaced first pin holes and said second rod section comprises a second transverse pin hole, for registry with a first pin hole, a locking pin adapted to extend through said registering first and second pin holes, said first pin holes being longitudinally spaced apart at incremental distances corresponding to incremental distances in vertical height.

10. The invention according to claim 9 further comprising a gauge on one of said rod sections having height indicia of equal incremental units, length adjustment indicia on said first rod section corresponding with said height indicia to identify a first pin hole to be registered with said second pin hole for receiving said locking pin so that the angle of said rod member with the floor in operative position will be substantially uniform.

11. The invention according to claim 1 in which said foot member has opposed first and second shoe surfaces, said first shoe surface having teeth for engaging the floor surface and said second shoe surface being relatively smooth and having a high coefficient of friction, and means for moving said respective first and second shoe surfaces to a floor-engaging position.

* * * * *